US005782018A

United States Patent [19]

Tozawa et al.

[11] Patent Number: 5,782,018

[45] Date of Patent: Jul. 21, 1998

[54] METHOD AND DEVICE FOR CONTROLLING BUCKET ANGLE OF HYDRAULIC SHOVEL

[75] Inventors: Shoji Tozawa; Tomoaki Ono, both of Hyogo, Japan

[73] Assignee: Shin Caterpillar Mitsubishi Ltd., Tokyo, Japan

[21] Appl. No.: 688,031

[22] Filed: Jul. 26, 1996

[30] Foreign Application Priority Data

Nov. 29, 1994 [JP] Japan ..... 6-295427

[51] Int. Cl.[6] ..... E02F 5/02

[52] U.S. Cl. ..... 37/348; 701/50; 414/699

[58] Field of Search ..... 37/348, 382, 195; 414/699, 694; 364/424.07

[56] References Cited

U.S. PATENT DOCUMENTS

| | | | |
|---|---|---|---|
| 5,356,259 | 10/1994 | Hanamoto et al. | 37/348 X |
| 5,442,868 | 8/1995 | Ahn | 37/348 |
| 5,446,980 | 9/1995 | Rocke | 37/348 |
| 5,446,981 | 9/1995 | Kamada et al. | 37/348 |
| 5,528,843 | 6/1996 | Rocke | 37/348 |
| 5,535,532 | 7/1996 | Fujii et al. | 37/348 |
| 5,535,830 | 7/1996 | Matsushita et al. | 172/4.5 X |
| 5,555,942 | 9/1996 | Matsushita et al. | 172/4.5 X |
| 5,598,648 | 2/1997 | Moriya et al. | 37/348 |

FOREIGN PATENT DOCUMENTS

| | | | |
|---|---|---|---|
| 0512584 | 11/1992 | European Pat. Off. . | |
| 59-150837 | 8/1984 | Japan . | |
| 60-55130 | 3/1985 | Japan . | |
| 62-013617 | 1/1987 | Japan . | |
| 62-160325 | 7/1987 | Japan . | |
| WO 91/02853 | 3/1991 | WIPO | 37/348 |

*Primary Examiner*—Terry Lee Melius
*Assistant Examiner*—Victor Batson
*Attorney, Agent, or Firm*—Morrison Law Firm

[57] ABSTRACT

A method and a device to control a bucket actuator, which controls the scooping, carrying, scraping, or digging action of the bucket, automatically switches between a bucket angle-maintaining control mode and a manual operation mode. The bucket angle-maintaining control mode, which automatically maintains a bucket angle, is used when the method determines that excavating is not being performed. The method automatically switches to the manual operation mode when the method determines, from the two parameters of bucket angle and stick movement, that excavating is being performed.

15 Claims, 5 Drawing Sheets

METHOD AND DEVICE FOR CONTROLLING BUCKET ANGLE OF HYDRAULIC SHOVEL

BACKGROUND OF THE INVENTION

This invention relates to a method and device for controlling an angle of the bucket of a hydraulic shovel which controls the scooping, carrying, scraping, or digging action of the bucket.

In the prior art, the angle of a scoop on a piece of machinery, such as a bucket of a hydraulic shovel for example, can be kept in a fixed angle relative to the platform of the machine.

FIG. 4(*a*) shows a manner of operation in the prior art which maintains a bucket 40bk of a hydraulic shovel 41 at a constant angle. The position of bucket 40bk is automatically controlled in such a manner that the angle of bucket 40bk is constant, keeping the open end of bucket 40bk approximately horizontal.

With the angle of bucket 40bk thus automatically maintained, bucket 40bk can be freely moved about without the danger of spilling the load, so long as the angle is automatically fixedly maintained. Such movement might be required, for example, before unloading onto a dump truck or other receptacle or disposal place.

In the prior art, the return to one angle from a fixed second angle can also be performed automatically. FIG. 4(*b*) shows a manner of the automatic return operation, i.e. an operation to return the bucket to the initial angle, of the prior art.

In order to dig, however, the bucket has to be manually operated by an operator using an operating lever to shovel the load. This requires the equipment to be released from the automatic bucket-angle-maintaining control mode. Thus, an operator of the equipment is forced to switch from an automatic control mode to a manual mode and back again for each action. This repetitive procedure can be tedious for the operator and may hinder effective use of the conventional bucket-angle-maintaining control mechanisms.

OBJECTS AND SUMMARY OF THE INVENTION

In order to solve the above problems, an object of the present invention is to provide a method of controlling an angle of the bucket of a hydraulic shovel, wherein the bucket-angle-maintaining control mode can be automatically deactivated.

It is an object of the present invention to provide a method of controlling an angle of the bucket of a hydraulic shovel suitable for smoothly performing excavation and transporting loads, such as excavated earth, onto a transportation vehicle.

It is an object of the present invention to provide a bucket-angle-control method which involves bucket angle control to maintain the bucket of a hydraulic shovel at a constant angle, in which the bucket-angle-maintaining control mode can be automatically turned off temporarily when excavation is detected to be taking place.

It is an object of the present invention is to provide a device for controlling an angle of the bucket of a hydraulic shovel, wherein the bucket-angle-maintaining control mode can be automatically deactivated.

It is an object of the present invention to provide a device for controlling an angle of the bucket of a hydraulic shovel suitable for smoothly performing excavation and transporting loads, such as excavated earth, onto a transportation vehicle.

It is an object of the present invention to provide a bucket-angle-control device which involves bucket angle control to maintain the bucket of a hydraulic shovel at a constant angle, in which the bucket-angle-maintaining control mode can be automatically turned off temporarily when excavation is detected to be taking place.

Briefly stated, a method and a device to control a bucket actuator, which controls the scooping, carrying, scraping, or digging action of the bucket, automatically switches between a bucket angle-maintaining control mode and a manual operation mode. The bucket angle-maintaining control mode, which automatically maintains a bucket angle, is used when the method determines that excavating is not being performed. The method automatically switches to the manual operation mode when the method determines, from the two parameters of bucket angle and stick movement, that excavating is being performed.

According to an embodiment of the present invention, a method to control a bucket actuator that moves a bucket comprising the steps of sensing a configuration of at least one of the bucket and the bucket actuator, determining whether the bucket is excavating or not excavating responsive to the step of sensing, setting the bucket actuator to a manual operation mode, which provides an operator manual control, when a result of the step of determining indicates the bucket is excavating; and setting the bucket actuator to a bucket angle-maintaining control mode, which provides an automatically controlled fixed bucket angle, when a result of the step of determining indicates the bucket is not excavating.

According to an embodiment of the present invention, a method to control a bucket actuator that moves a bucket comprising the steps of sensing a position of the bucket, sensing an action of a stick to which the bucket is pivotally attached, determining whether the bucket is excavating or not excavating from at least one of the sensed position and the sensed action, setting the bucket actuator to a manual operation mode, which provides an operator manual control, when a result of the step of determining indicates the bucket is excavating; and setting the bucket actuator to a bucket angle-maintaining control mode, which provides an automatically controlled fixed bucket angle, when a result of the step of determining indicates the bucket is not excavating.

According to another embodiment of the present invention, a method to control a bucket actuator that moves a bucket comprising the steps of sensing a position of the bucket, sensing an action of a stick to which the bucket is pivotally attached, determining whether the bucket is excavating or not excavating from both the sensed position and the sensed action, setting the bucket actuator to a manual operation mode, which provides an operator manual control, when a result of the step of determining indicates the bucket is excavating; and setting the bucket actuator to a bucket angle-maintaining control mode, which provides an automatically controlled fixed bucket angle, when a result of the step of determining indicates the bucket is not excavating.

According to an embodiment of the present invention, a device to control a bucket actuator that moves a bucket comprising means for sensing a configuration of at least one of the bucket and the bucket actuator, means for determining, responsive to the means for sensing, whether the bucket is excavating or not excavating, means for setting the bucket actuator to a manual operation mode, which provides an operator manual control, when a result of the step of determining indicates the bucket is excavating; and means for setting the bucket actuator to a bucket angle-maintaining control mode, which provides an automatically controlled fixed bucket angle, when a result of the step of determining indicates the bucket is not excavating.

According to an embodiment of the present invention, a device to control a bucket actuator that moves a bucket comprising means for sensing a position of the bucket, means for sensing an action of a stick to which the bucket is pivotally attached, means for determining whether the bucket is excavating or not excavating from at least one of the sensed position and the sensed action, means for setting the bucket actuator to a manual operation mode, which provides an operator manual control, when a result of the means for determining indicates the bucket is excavating; and means for setting the bucket actuator to a bucket angle-maintaining control mode, which provides an automatically controlled fixed bucket angle, when a result of the means for determining indicates the bucket is not excavating.

According to another embodiment of the present invention, a device to control a bucket actuator that moves a bucket comprising means for storing a stored position of the bucket, means for sensing a sensed position of the bucket, means for sensing an action of a stick to which the bucket is pivotally attached, a controller, the controller makes a comparison of the stored position with the sensed position to determine whether the bucket is consistent with excavating or not excavating, the controller makes a determination from the sensed action of whether the stick is consistent with excavating or not excavating, the controller setting the bucket actuator to a manual operation mode, which provides an operator manual control, when the controller determines from a result of the comparison and the determination indicates that both the bucket is consistent with excavating and the stick is consistent with excavating; and the controller setting the bucket actuator to a bucket angle-maintaining control mode, which provides an automatically controlled fixed bucket angle, when the result of the comparison and the determination indicates that one of the bucket and the stick is not consistent with excavating.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 4(*b*) is a drawing which illustrates the action of a hydraulic shovel at the time of an automatic return operation.

DETAILED DESCRIPTION OF THE PREFERRED EMBODIMENT

Figure 1:
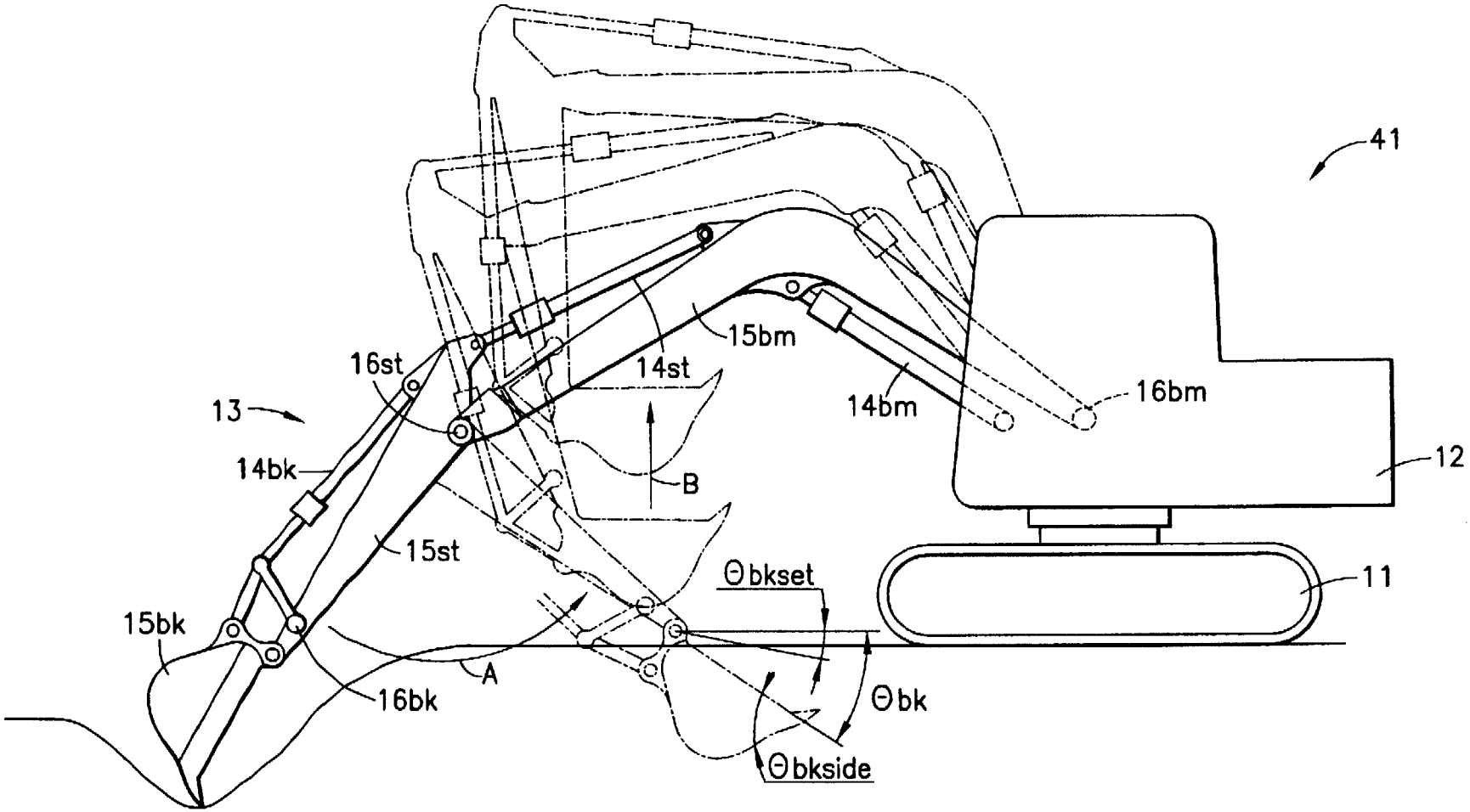
FIG. 1 is a drawing which illustrates an example of an action governed by a method according an embodiment of the present invention of controlling an angle of a bucket of a hydraulic shovel.

The present invention comprises a bucket-angle-control method which automatically controls the bucket angle to maintain the bucket of a hydraulic shovel at a constant angle, in which the bucket-angle-maintaining control mode can be automatically turned off temporarily when excavation is detected to be taking place. The bucket of a hydraulic shovel is shaped to allow various operations such as scooping, carrying, scraping, or digging.

With the present invention, even while the equipment is under bucket-angle-maintaining control so as not to spill the load, the bucket can be automatically released from this control whenever the bucket proceeds into digging, thereby permitting manual excavation in the same manner as conventional hydraulic shovels. At the time in preparation of unloading, when the bucket is no longer digging, the bucket is controlled in the normal bucket angle-maintaining control mode at such a position as to prevent the load from spilling.

When the bucket is carrying a load, the bucket is under a bucket-angle-maintaining control mode in which the machine operator does not need to worry about the angle of the bucket. The angle is maintained by a controller to prevent spillage with no input from the operator. However, should the operator move the bucket to a position which the present invention recognizes as no longer requiring that the angle be maintained, the present invention automatically releases the bucket-angle-maintaining control mode to the manual operation mode where the angle of the bucket or scoop is completely under the operator's control. When the present invention determines that the position of the scoop or bucket is such that the angle should again be maintained, the present invention automatically resets the machine to the bucket-angle-maintaining control mode wherein the angle is maintained unless the operator, by operation of a manual control, overrides such control.

According to a feature of the invention, the equipment is determined to be performing excavation when the angle of the open surface of the bucket with respect to the horizontal plane is found to exceed a specified value. The method according to the present invention holds the bucket at a constant angle when the open surface of the bucket is approximate to the horizontal plane. At other times, the bucket is assumed to be performing excavation or pouring and is automatically switched from the bucket angle-maintaining control mode to manual operation mode. Accordingly, because the parameters for detecting when manual operation is required are not complex, the method according to the present invention is easily handled by an automatic control system.

According to a feature of the invention, the method to control a bucket actuator includes a determining step which includes making a first determination of the stick action as being consistent with excavating or non-excavating, making a second determination of the bucket position as being consistent with excavating or non-excavating, and combining the first determination and the second determination such that only a combination of the first determination being consistent with excavating and the second determination being consistent with excavating is a determining result that indicates the bucket is excavating.

According to a feature of the invention, the method to control a bucket actuator includes making a second determination step which includes storing a stored bucket angle, sensing a sensed bucket angle, making a comparison of the sensed bucket angle to the stored bucket angle, and the making a second determination step indicates consistent with excavating when a result of the comparison is the sensed bucket angle being smaller than the stored bucket angle.

According to a feature of the invention, the method to control a bucket actuator includes the steps of sensing and making a comparison repeated at least once.

According to a feature of the invention, the method to control a bucket actuator includes the making a second determination step which includes storing a standard value of a pressure on a head-side of a stick cylinder of the stick, sensing a sensed value of a pressure on a head-side of a stick cylinder of the stick making a comparison of the sensed value to the standard value and the making a second determination step indicates consistent with excavating when a result of the comparison is the sensed value being greater than the standard value.

According to a feature of the invention, the method to control a bucket actuator includes making a first determination step which includes sensing a movement of a stick cylinder rod into a stick cylinder, the sensed movement into the stick cylinder indicates consistent with excavating, wherein the stick cylinder rod is hydraulically driven by the stick cylinder and the stick cylinder controls movement of the stick.

According to a feature of the invention, the method to control a bucket actuator includes the making a first determination step which includes sensing a movement of a stick cylinder rod out from a stick cylinder, the sensed movement out from the stick cylinder indicates consistent with excavating, wherein the stick cylinder rod is hydraulically driven by the stick cylinder and the stick cylinder controls movement of the stick.

According to a feature of the invention, the method to control a bucket actuator includes the making a first determination step which includes sensing a change of a distance relationship between the stick and a boom, wherein the stick is pivotally attached to the boom.

According to a feature of the invention, the method to control a bucket actuator includes the determining step which includes making a first determination of the stick action as being consistent with excavating or non-excavating, the making a first determination step includes sensing a movement of a stick cylinder rod into a stick cylinder, the sensed movement into the stick cylinder indicates consistent with excavating, wherein the stick cylinder rod is hydraulically driven by the stick cylinder and the stick cylinder controls movement of the stick, making a second determination of the bucket position as being consistent with excavating or non-excavating, the making a second determination step includes the steps of (a) storing a stored bucket angle, (b) sensing a sensed bucket angle, and (c) making a comparison of the sensed bucket angle to the stored bucket angle, the making a second determination step indicates consistent with excavating when a result of the comparison is the sensed bucket angle being smaller than the stored bucket angle, combining a first result from the making a first determination step and a second result from the making a second determination step such that only a combination of the first result being consistent with excavating and the second result being consistent with excavating is a determining result that indicates the bucket is excavating.

According to a feature of the invention, the method to control a bucket actuator includes the steps of making a first determination, making a second determination, and combining being repeated at least once.

Figure 2:
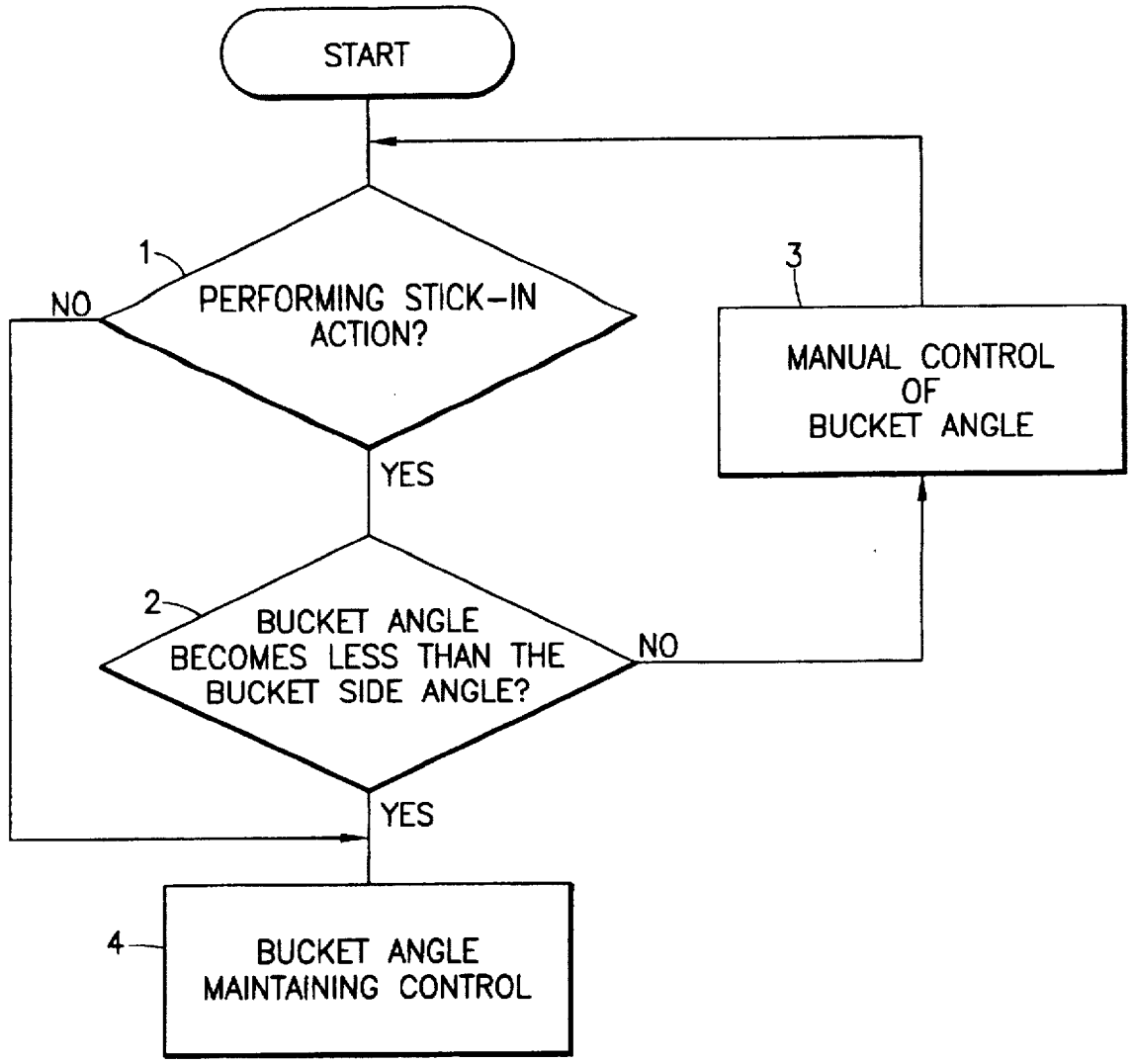
FIG. 2 is a flow chart describing an embodiment of the present invention.
Figure 3:
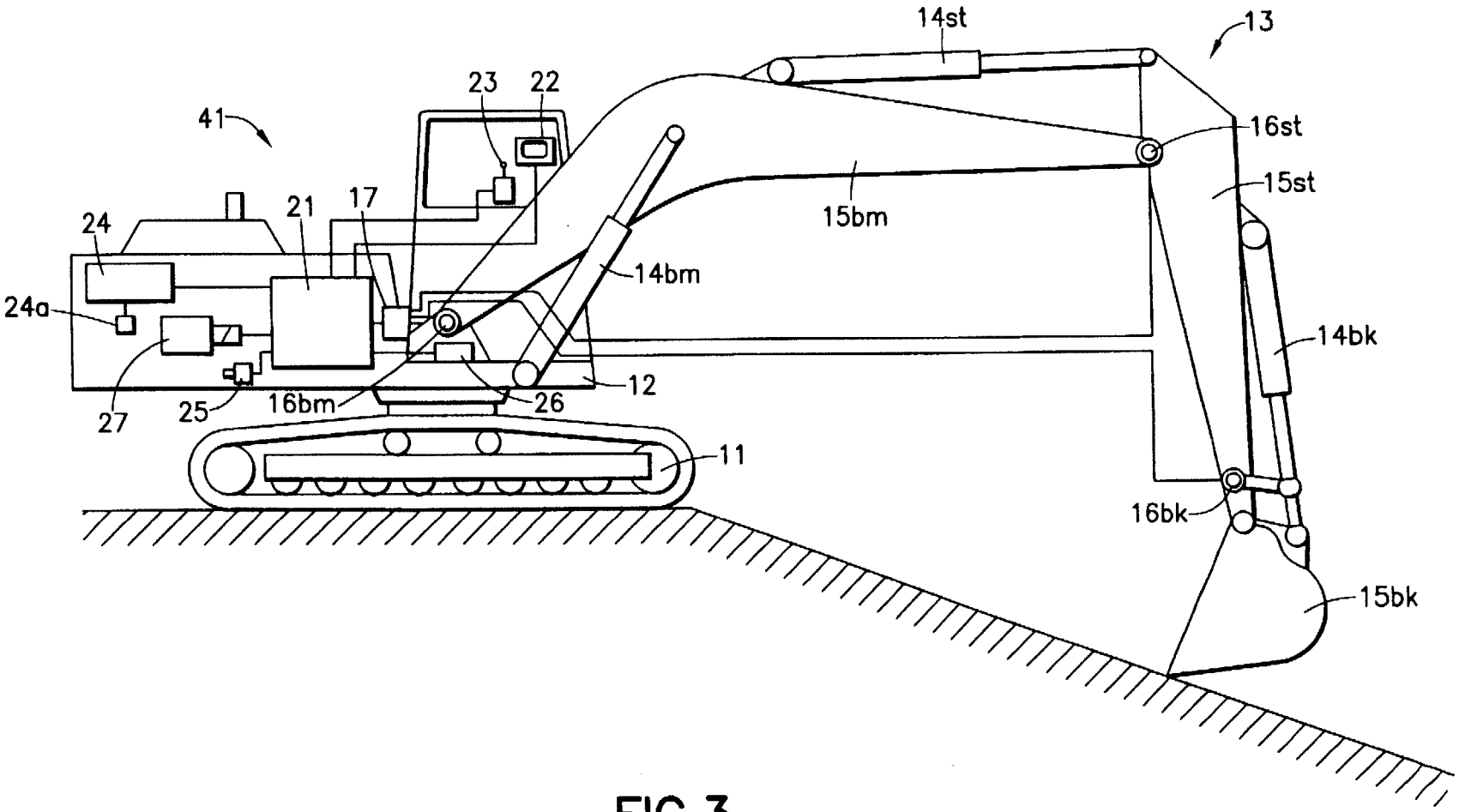
FIG. 3 is a system configuration diagram of a hydraulic shovel using an embodiment of the present invention.
Figure 4A:
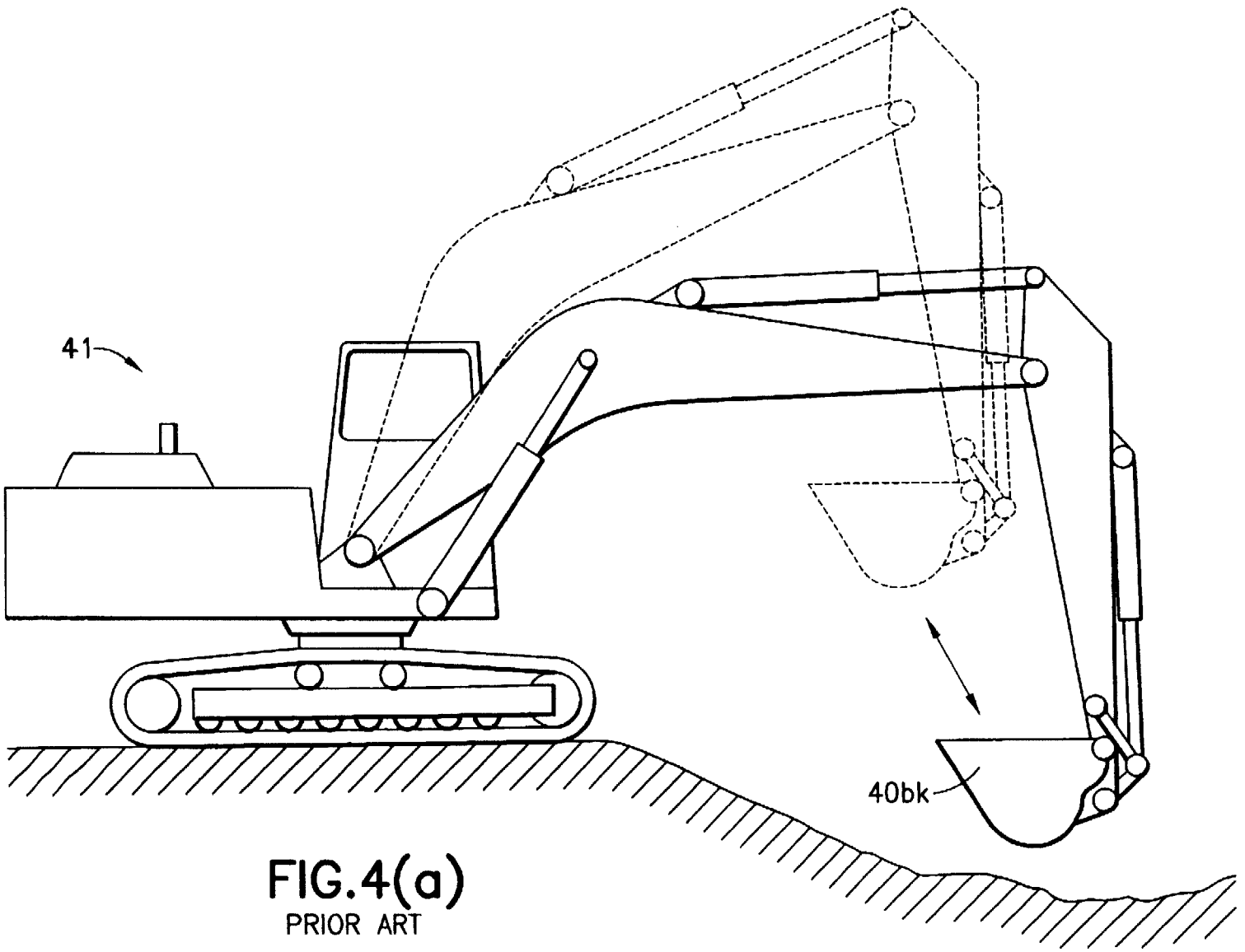
FIG. 4(a) PRIOR ART
FIG. 4(*a*) is a drawing which illustrates the action of a hydraulic shovel when its bucket is controlled at a constant angle.
Figure 4B:
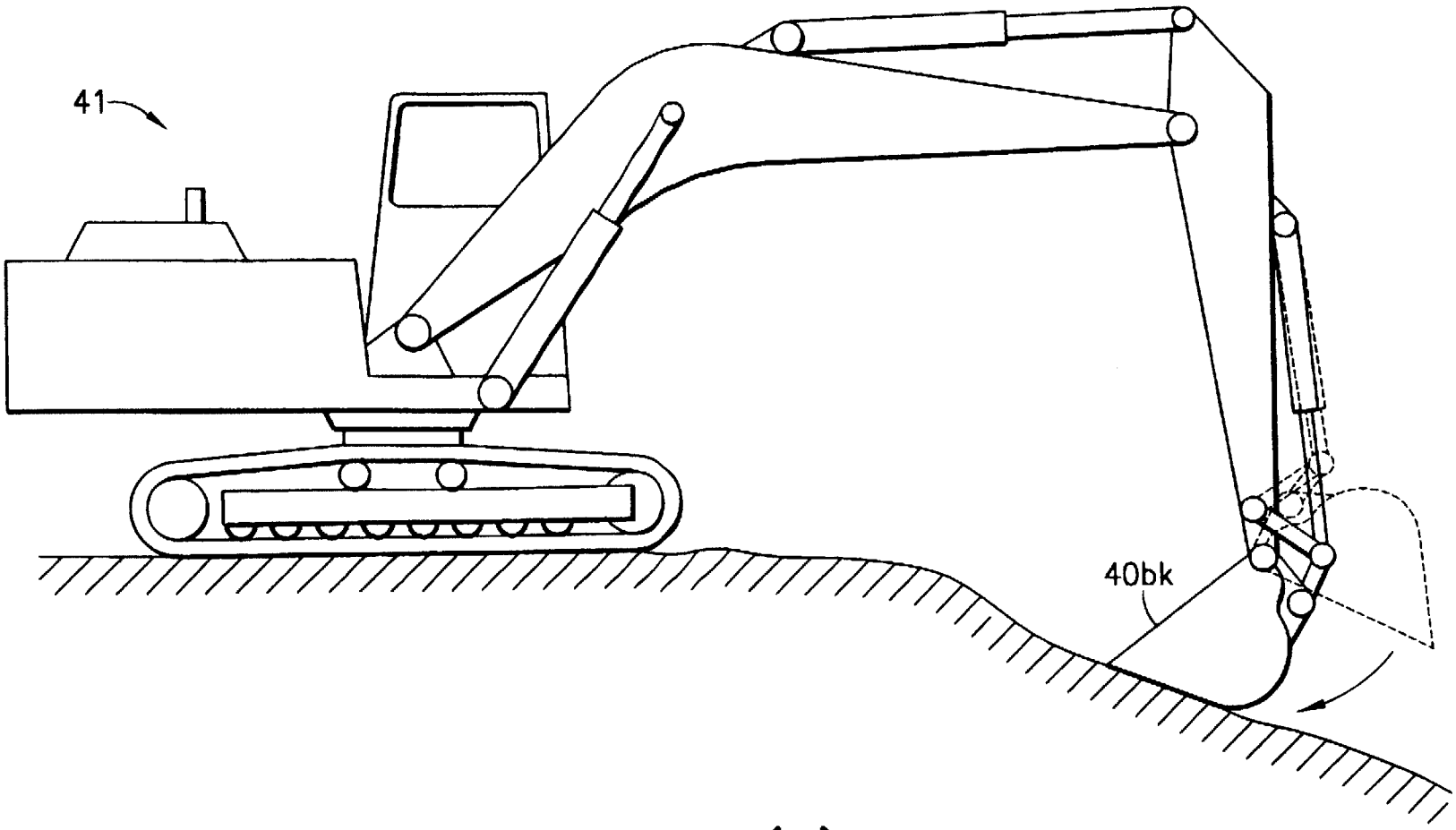
FIG. 4(b) PRIOR ART

An embodiment of the present invention is shown in FIGS. 1 to 3. FIG. 3 shows a system configuration of hydraulic shovel 41 equipped with a control device according to the present invention for controlling a machine assembly such as an attachment 13. Hydraulic shovel 41 has a lower structure 11 and an upper structure 12. Upper structure 12 is mounted on lower structure 11 and attachment 13 is mounted on upper structure 12.

Attachment 13 includes a member such as a boom 15bm, another member such as a stick 15st and a scooping member such as a bucket 15bk. Boom 15bm is rotated by an actuator such as a boom cylinder 14bm and supported at its base end by upper structure 12 through a shaft. Stick 15st is rotated by an actuator such as a stick cylinder 14st and stick 15st's base portion is joined to the front end of boom 15bm and supported there through a shaft. Bucket 15bk is pivoted by an actuator such as a bucket cylinder 14bk and joined to, and supported at, the front end of stick 15st through a shaft. Boom cylinder 14bm, stick cylinder 14st and bucket cylinder 14bk are hydraulic actuators that operate attachment 13.

Rotation angles of boom 15bm, stick 15st and bucket 15bk are respectively detected by angle sensors 16bm, 16st and 16bk, which may be resolvers used as attachment sensors or any other suitable means. Signals representing detected angles are input through a signal transformer 17 mounted on upper structure 12 into a controller 21. Controller 21 includes a microcomputer.

Connected to controller 21 is a display switch panel 22 which serves as an input/output device. Elements connected to the input terminal of the controller include a switch 23, an engine pump controller 24, one or more pressure sensors 25 and an inclination sensor 26. Switch 23 is mounted on the operation lever of attachment 13 or any other suitable location. Engine pump controller 24 controls an engine and a pump, not shown, based on the engine speed detected by an engine speed sensor 24a. Pressure sensors 25 detect the pressure of the hydraulic circuits for driving attachment 13 and inclination sensor 26 detects an angle of inclination of hydraulic shovel 41. Further, one or more electromagnetic valves 27 that include electromagnetic proportional control valves and electromagnetic change valves are connected to the output terminal of controller 21.

Based on signals representing respective rotation angles of boom 15bm, stick 15st and bucket 15bk which have been detected by angle sensors 16bm, 16st, and 16bk, controller 21 is capable of constantly monitoring a bucket angle θbk. FIG. 1 shows θbk, an angle of the bucket open surface with respect to the horizontal plane.

Therefore, by means of controller 21 electrically controlling electromagnetic valves 27 to control the pilot pressure of pilot-operated control valves which extend and contract bucket cylinder 14bk, it is possible to maintain the bucket angle θbk at a specified angle, including 0°, automatically so as to prevent bucket 15bk from spilling.

FIG. 1 shows a carrying operation where the present invention includes a bucket angle-maintaining mode B, so that when earth, sand or other materials are being carried for unloading, the bucket is maintained, without manually operating the bucket operation lever, at such a position as to prevent its load from spilling.

FIG. 1 shows an excavation operation where the present invention includes an excavation mode A. In excavation mode A, having detected that excavation is underway, controller 21 automatically deactivates the bucket-angle-maintaining function temporarily, thereby enabling manual operation.

During an excavation operation with the backhoe-type hydraulic shovel 41 shown in FIG. 1, stick 15st is drawn in ("stick-in action") and that bucket angle θbk with respect to the horizontal plane is greater than a specified standard value θbk set. In other words, when stick-in action occurs and θbk>θbkset, the controller determines that the excavation is underway.

Other type hydraulic shovels such as, for example, bulldozers, where the stick is drawn out in an excavation operation would substitute the equivalent parameter of the stick going out action for the present example's "stick-in" action.

Presence of stick-in action can be judged from the angular speed (positive or negative) of stick 15st which can be detected according to the direction of inclination of the stick operation lever or of angle sensor 16st. Further, a bucket side angle θbkside may be used as specified standard value θbk set to determine the transition point between bucket angle-maintaining mode B and excavation mode A.

Except when the two conditions of stick-in action and (θbk>θbkset) are satisfied, bucket-angle-maintaining mode B is conducted, wherein the pilot pressure of the bucket cylinder control valves is automatically controlled by means of electromagnetic valves while, as described above, bucket angle θbk is monitored by angle sensors 16bm, 16st, and 16bk. Thus, bucket-angle-maintaining mode B controls extension and contraction of bucket cylinder 14bk to maintain bucket angle θbk to prevent spilling a load being carried.

FIG. 2 is a flow chart of the bucket-angle-maintaining control of an embodiment of the present invention.

When the bucket-angle-maintaining control is initiated, a judgment is made in a Step (1) as to whether stick-in action is underway, i.e. whether stick 15st is being drawn in, during an excavation operation.

If there is stick-in action ("YES" in Step (1)), a judgment is made in a Step (2) as to whether bucket angle θbk is smaller than bucket side angle θbkside, which serves as the specified standard value θbkset.

If bucket angle θbk is greater ("NO" in Step (2)), which means that stick-in action is accompanied by θbk>θbkside, controller 21 judges that digging action is underway. Therefore, even if the equipment is in the bucket angle-maintaining mode B, controller 21 automatically deactivates, in a Step (3), the function which maintains the bucket-angle, permitting stick 15st and bucket 15bk to be manually operated by means of the manual operation levers to continue the excavation (Step (3)).

In cases other than the above ("YES" in Step (2)), the system returns to or maintains the normal bucket-angle-maintaining control in a Step 4. If no stick-in action was found in Step (1) ("NO" in Step (1)), bucket angle-maintaining mode B is initiated or maintained. In bucket angle-maintaining mode B, bucket 15bk is moved with bucket angle θbk being automatically maintained constant for the intended operation such as unloading Hence, only for one combination, out of four, of results of steps 1 and 2 leads to manual control of bucket angle. The other three combinations lead to bucket angle-maintaining mode B.

Steps 1 and 2 are determinations of two independent parameters, each of which can be determined as being either excavating or non-excavating. The present invention makes a determination of the status of each parameter and for only one combination of the possible four combinations is the mode of bucket operation set automatically to excavation mode A, that is, the manual operation mode. For the other three combinations the mode of bucket operation is set to bucket angle-maintaining mode B.

According to an embodiment of the present invention, one parameter is bucket angle θbk. The system determines that excavation is underway, for that parameter, when bucket angle θbk exceeds a specified standard value. The angles are determined by any convenient means such as, for example, mechanical, optical, or magnetic indexing, tension, compression, or torsion gauges.

According to another embodiment of the present invention, one parameter is the pressure on the head-side of stick cylinder 14st. The system determines that excavation is underway, for that parameter, when a pressure sensor 25 detects pressure, greater than a standard value, on the head-side of stick cylinder 14st.

According to another embodiment of the present invention, one parameter is the distance between stick 15st and boom 15bm. The system determines that excavation is underway, for that parameter, when a distance relationship between stick 15st and boom 15bm changes. The distance is determined by any convenient means such as, for example, mechanical, optical, or magnetic ranging.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

Although only a single or few exemplary embodiments of this invention have been described in detail above, those skilled in the art will readily appreciate that many modifications are possible in the exemplary embodiment (s) without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

What is claimed is:

1. A device to control a bucket actuator that moves a bucket comprising:

means for sensing a configuration of at least one of said bucket and said bucket actuator;

means for determining, responsive to said means for sensing, whether said bucket is excavating or not excavating;

means for setting said bucket actuator to a manual operation mode, which provides an operator manual control, when a result of said step of determining indicates said bucket is excavating; and means for setting said bucket actuator to a bucket angle-maintaining control mode, which provides an automatically controlled fixed bucket angle, when a result of said step of determining indicates said bucket is not excavating.

2. A device to control a bucket actuator that moves a bucket comprising:

means for sensing a position of said bucket with respect to a datum, to produce a sensed position;

means for sensing an action of a stick to which said bucket is pivotally attached to produce a sensed action;

means for storing a value of said sensed position to produce a stored bucket position;

means for determining whether said bucket is excavating or not excavating from at least one of said sensed position, said stored bucket position and said sensed action;

means for setting said bucket actuator to a manual operation mode, which provides an operator manual control, when a result of said means for determining indicates said bucket is excavating; and means for setting said bucket actuator to a bucket angle-maintaining control mode, which provides an automatically controlled fixed bucket position substantially equal to said stored bucket position, when a result of said means for determining indicates said bucket is not excavating.

3. A device to control a bucket actuator according to claim 2 wherein said controller determines that said stick is consistent with excavating when said sensed action is a movement of a rod in a stick cylinder of said stick, wherein said movement is in an excavating direction.

4. A device to control a bucket actuator according to claim 2 wherein said stored position is a stored bucket angle position and said sensed position is a sensed angle position.

5. A device to control a bucket actuator according to claim 2 wherein:

said stored bucket position is a stored angle position and said sensed position is a sensed angle position; and said controller determines that said stick is consistent with excavating when said sensed action is a movement of a rod in a stick cylinder of said stick, wherein said movement is in an excavating direction.

6. A device to control a bucket actuator that moves a bucket comprising:

means for sensing a position of said bucket with respect to a datum to produce a sensed bucket position;

means for storing a value of said sensed bucket position to produce a stored bucket position;

means for sensing an action of a stick to which said bucket is pivotally attached to produce a sensed action;

a controller, said controller for making a comparison of said stored bucket position with said sensed bucket position to determine whether said bucket is consistent with excavating or not excavating, said controller further for making a determination from said sensed action whether said stick is consistent with excavating or not excavating;

said controller programmed to set said bucket actuator to a manual operation mode, which provides an operator manual control, when said controller determines from a result of said comparison and said determination indicates that both said bucket is consistent with excavating and said stick is consistent with excavating; and said controller programmed to set said bucket actuator to a bucket angle-maintaining control mode, which provides an automatically controlled fixed bucket position substantially equal to said stored bucket position, when said result of said comparison and said determination indicates that one of said bucket and said stick is not consistent with excavating.

7. A method to control a bucket actuator that moves a bucket comprising the steps of:

sensing a configuration of at least one of said bucket and said bucket actuator to produce a sensed bucket angle with respect to a datum;

storing a value of said sensed bucket angle;

determining whether said bucket is excavating or not excavating responsive to said step of sensing;

setting said bucket actuator to a manual operation mode, which provides an operator manual control, when a result of said step of determining indicates said bucket is excavating; and setting said bucket actuator to a bucket angle-maintaining control mode, which provides an automatically controlled fixed bucket angle substantially equal to said stored bucket angle when a result of said step of determining indicates said bucket is not excavating.

8. A method to control a bucket actuator that moves a bucket comprising the steps of:

sensing a position of said bucket to produce a sensed bucket angle with respect to a datum;

storing a value of said sensed bucket angle to produce a stored bucket angle;

sensing an action of a stick to which said bucket is pivotally attached to determine a sensed action;

determining whether said bucket is excavating or not excavating from at least one of said sensed bucket angle, said stored bucket angle and said sensed action;

setting said bucket actuator to a manual operation mode, which provides an operator manual control, when a result of said step of determining indicates said bucket is excavating; and setting said bucket actuator to a bucket angle-maintaining control mode, which provides an automatically controlled fixed bucket angle substantially equal to said stored bucket angle when a result of said step of determining indicates said bucket is not excavating.

9.A method to control a bucket actuator according to claim 8 wherein said determining step includes:

making a first determination of said stick action as being consistent with excavating or non-excavating;

making a second determination of said bucket position as being consistent with excavating or non-excavating; and combining said first determination and said second determination such that only a combination of said first determination being consistent with excavating and said second determination being consistent with excavating is a determining result that indicates said bucket is excavating.

10. A method to control a bucket actuator according to claim 9, wherein said making a second determination step includes:

storing a standard value of a pressure on a head-side of a stick cylinder of said stick;

sensing a sensed value of a pressure on a head-side of a stick cylinder of said stick making a comparison of said sensed value to said standard value; and said making a second determination step indicates consistent with excavating when a result of said comparison is said sensed value being greater than said standard value.

11. A method to control a bucket actuator according to claim 9 wherein said making a first determination step includes sensing a movement of a stick cylinder rod into a stick cylinder, said sensed movement into said stick cylinder indicates consistent with excavating, wherein said stick cylinder rod is hydraulically driven by said stick cylinder and said stick cylinder controls movement of said stick.

12. A method to control a bucket actuator according to claim 9 wherein said making a first determination step includes sensing a movement of a stick cylinder rod out from a stick cylinder, said sensed movement out from said stick cylinder indicates consistent with excavating, wherein said stick cylinder rod is hydraulically driven by said stick cylinder and said stick cylinder controls movement of said stick.

13. A method to control a bucket actuator according to claim 9, wherein said making a first determination step includes sensing a change of a distance relationship between said stick and a boom, wherein said stick is pivotally attached to said boom.

14. A method to control a bucket actuator according to claim 8 wherein said determining step includes:

making a first determination of said stick action as being consistent with excavating or non-excavating, said making a first determination step includes sensing a movement of a stick cylinder rod into a stick cylinder, said sensed movement into said stick cylinder indicates consistent with excavating, wherein said stick cylinder rod is hydraulically driven by said stick cylinder and said stick cylinder controls movement of said stick;

making a second determination of said bucket position as being consistent with excavating or non-excavating, said making a second determination step includes the steps of (a) storing a stored bucket angle, (b) sensing a sensed bucket angle, and (c) making a comparison of said sensed bucket angle to said stored bucket angle, said making a second determination step indicates consistent with excavating when a result of said comparison is said sensed bucket angle being smaller than said stored bucket angle;

combining a first result from said making a first determination step and a second result from said making a second determination step such that only a combination of said first result being consistent with excavating and said second result being consistent with excavating is a determining result that indicates said bucket is excavating.

15. A method to control a bucket actuator that moves a bucket comprising the steps of:

sensing a position of said bucket to produce a sensed bucket angle with respect to a datum;

storing a value of said sensed bucket angle to produce a stored bucket angle;

sensing an action of a stick to which said bucket is pivotally attached to determine a sensed action;

determining whether said bucket is excavating or not excavating from said sensed bucket angle, said stored bucket angle and said sensed action;

setting said bucket actuator to a manual operation mode, which provides an operator manual control, when a result of said step of determining indicates said bucket is excavating; and setting said bucket actuator to a bucket angle-maintaining control mode, which provides an automatically controlled fixed bucket angle substantially equal to said stored bucket angle when a result of said step of determining indicates said bucket is not excavating.

* * * * *